US007784780B2

(12) United States Patent
Nanno et al.

(10) Patent No.: US 7,784,780 B2
(45) Date of Patent: Aug. 31, 2010

(54) MANUAL SHEET-FEEDING DEVICE AND IMAGE FORMING APPARATUS

(75) Inventors: Shigeo Nanno, Kyoto (JP); Yasuhide Ohkubo, Osaka (JP); Ippei Kimura, Osaka (JP); Yoshihide Ohta, Kanagawa (JP); Tomoyoshi Yamazaki, Ibaraki (JP); Haruyuki Honda, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 527 days.

(21) Appl. No.: 11/798,108

(22) Filed: May 10, 2007

(65) Prior Publication Data

US 2007/0273085 A1 Nov. 29, 2007

(30) Foreign Application Priority Data

May 11, 2006 (JP) ..... 2006-133126

(51) Int. Cl.
*B65H 3/44* (2006.01)
*B65H 5/26* (2006.01)

(52) U.S. Cl. ..... 271/9.09; 271/171

(58) Field of Classification Search ..... 271/171, 271/9.09

See application file for complete search history.

(56) References Cited

U.S. PATENT DOCUMENTS

| | | | | |
|---|---|---|---|---|
| 5,261,651 | A * | 11/1993 | Ishida | 271/3.2 |
| 5,332,209 | A * | 7/1994 | Romansky et al. | 271/171 |
| 5,746,528 | A * | 5/1998 | Mayer et al. | 400/625 |
| 5,927,702 | A * | 7/1999 | Ishii et al. | 271/9.09 |
| 7,547,014 | B2 * | 6/2009 | Okuda et al. | 271/171 |
| 7,562,867 | B2 * | 7/2009 | Asada et al. | 271/9.09 |
| 2003/0178764 | A1 * | 9/2003 | Hasegawa | 271/171 |
| 2004/0036208 | A1 * | 2/2004 | Yanagi et al. | 271/171 |
| 2004/0114980 | A1 * | 6/2004 | Nanno | 400/188 |
| 2005/0073085 | A1 * | 4/2005 | Fukada et al. | 271/9.09 |
| 2005/0253323 | A1 * | 11/2005 | Fujita et al. | 271/9.09 |
| 2007/0172255 | A1 * | 7/2007 | Nanno et al. | 399/124 |

FOREIGN PATENT DOCUMENTS

| | | | |
|---|---|---|---|
| JP | 62-11842 | | 1/1987 |
| JP | 63112328 | A * | 5/1988 |
| JP | 01-236153 | | 9/1989 |
| JP | 02117540 | A * | 5/1990 |
| JP | 04-016448 | | 1/1992 |
| JP | 11-212317 | | 8/1999 |
| JP | 2002-187645 | | 7/2002 |
| JP | 2004-196463 | | 7/2004 |
| JP | 2007153450 | A * | 6/2007 |

* cited by examiner

*Primary Examiner*—Patrick Mackey
*Assistant Examiner*—Prasad V Gokhale
(74) *Attorney, Agent, or Firm*—Harness, Dickey & Pierce, P.L.C.

(57) ABSTRACT

An adjusting member is positioned in a sheet feeding opening. The adjusting member is adjusted according to the size of the paper sheet. The adjusting member does not jut out of an exterior surface of an apparatus body.

11 Claims, 4 Drawing Sheets

MANUAL SHEET-FEEDING DEVICE AND IMAGE FORMING APPARATUS

CROSS-REFERENCE TO RELATED APPLICATIONS

The present document incorporates by reference the entire contents of Japanese priority document, 2006-133126 filed in Japan on May 11, 2006.

BACKGROUND OF THE INVENTION

1. Field of the Invention

The present invention relates to a manual sheet-feeding device and an image forming apparatus that includes the manual-sheet-feeding device.

2. Description of the Related Art

A manual sheet-feeding device is known that is configured to adjust the position of a sheet and guide the sheet into the apparatus body. The manual sheet-feeding device includes an apparatus body; a sheet feeding opening in the apparatus body; and an adjusting member that is movable in a direction orthogonal to a direction of insertion of a sheet into the sheet feeding opening.

A related technology is disclosed in Japanese Patent Application Laid-open No. 2004-196463. An image forming apparatus disclosed in the document includes a manual sheet-feeding device that includes an adjusting member configured to adjust the position of a sheet in the sheet-width direction so that the sheet is conveyed properly. The image forming apparatus has a sheet feeding opening in the apparatus body for feeding a sheet. In other words, the image forming apparatus does not include a sheet feeding tray that is attached to the apparatus body so as to jut out of the apparatus body. Because of the absence of the sheet feeding tray, the image forming apparatus can be downsized.

However, the adjusting member of the conventional manual sheet-feeding device juts out of the apparatus body and there is a risk that the user's cloths may get caught in the adjusting member, or the user may hit his hand on the adjusting member, thereby damaging the adjusting member. In case the adjusting member moves because, for example, the user hits his hand on the adjusting member after the adjusting member has adjusted the position of the sheet, the adjusting member needs to readjust the position of the sheet.

SUMMARY OF THE INVENTION

It is an object of the present invention to at least partially solve the problems in the conventional technology.

According to an aspect of the present invention, a manual sheet-feeding device includes an apparatus body having an exterior surface, a sheet feeding opening for inserting a sheet into the apparatus body, and an opening for inserting the sheet into the sheet feeding opening; and an adjusting member that is positioned in the sheet feeding opening and that does not jut out of the exterior surface, that is movable in a direction substantially orthogonal to a direction of insertion of the sheet into the-sheet feeding opening for adjusting a position of the sheet, and that guides the sheet in interior of the apparatus body.

According to another aspect of the present invention, an image forming apparatus includes a manual sheet-feeding device including an apparatus body having an exterior surface, a sheet feeding opening for inserting a sheet into the apparatus body, and an opening for inserting the sheet into the sheet feeding opening; and an adjusting member that is positioned in the sheet feeding opening and that does not jut out of the exterior surface, that is movable in a direction substantially orthogonal to a direction of insertion of the sheet into the sheet feeding opening for adjusting a position of the sheet, and that guides the sheet in interior of the apparatus body; and an image forming device that forms an image on the sheet fed by the manual sheet-feeding device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
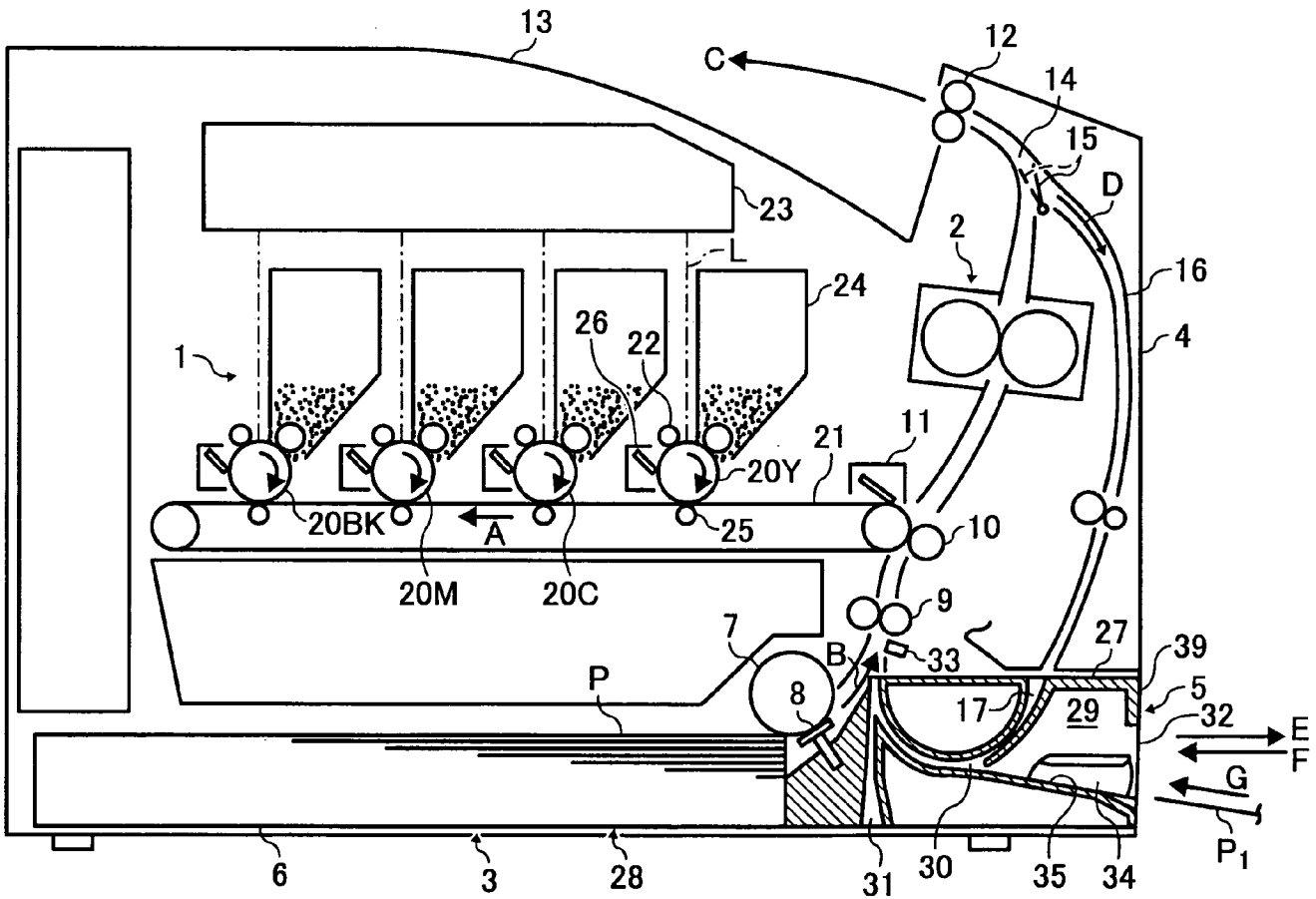
FIG. 1 is a schematic side view of an image forming apparatus according to an embodiment of the present invention.

FIG. 1 is a schematic side view of an image forming apparatus that includes a manual sheet-feeding device according to an embodiment of the present invention. The image forming apparatus includes an image forming device 1 housed in an image-forming-apparatus body 4, a sheet-feeding device 3 configured to feed a sheet to the image forming device 1, and a manual sheet-feeding device 5 that is explained in detail below.

The image forming device 1 includes first to fourth image bearing media 20Y, 20C, 20M, and 20BK that are drum-shaped photoreceptors. An endless intermediate transfer belt 21 is wound around and stretches across a plurality of supporting rollers so as to face the first to fourth image bearing media 20Y, 20C, 20M, and 20BK. Each of the first to fourth image bearing media 20Y, 20C, 20M, and 20BK is driven to rotate clockwise, and thus, the intermediate transfer belt 21 is driven to rotate in the direction indicated by an arrow A.

The surface of the first image bearing media 20Y is electrically charged to a certain polarity by a charging roller 22. The charged surface of the first image bearing media 20Y is then irradiated with a laser beam L optically modulated by and emitted from a beam applying unit 23. Accordingly, an electrostatic latent image is formed on the surface of the first image bearing media 20Y, and the electrostatic latent image is visualized as a yellow toner image by a developing unit 24. A transfer voltage is applied to a primary transfer roller 25, and accordingly, the toner image on the first image bearing media 20Y is primary-transferred to the intermediate transfer belt 21. Thereafter, a cleaning unit 26 removes any residual toner present on the surface of the first image bearing media 20Y.

In the same manner as that described above, each of cyan, magenta, and black toner images are formed on each of the surfaces of the second to fourth image bearing media 20C, 20M, and 20BK. The cyan, magenta, and black toner images are primary-transferred sequentially to the intermediate transfer belt 21 to which the yellow toner image is already transferred.

The sheet feeding device 3 is positioned below the intermediate transfer belt 21. The sheet feeding device 3 includes a sheet tray 6 for storing paper sheets P, a sheet feeding roller 7 that contacts with the top one of the paper sheets P, and a friction pad 8. The presence of the friction pad 8 and the rotation of the sheet feeding roller 7 cause the top paper sheet P to be fed from the sheet tray 6 in the direction indicated by an arrow B. The paper sheet P is conveyed, at certain timing, by a pair of rotating resist rollers 9 so as to be positioned between the transfer belt 21 and a secondary transfer roller 10 that faces the transfer belt 21. A transfer voltage is applied to the secondary transfer roller 10. Accordingly, the layered toner image on the intermediate transfer belt 21 is secondary-transferred to the paper sheet P. Thereafter, a belt cleaning unit 11 removes any residual toner present on the intermediate transfer belt 21.

The paper sheet P having the toner image thereon then passes through a fixing unit 2 that fixes the toner image to the paper sheet by using heat and pressure. Thereafter, a pair of sheet discharging rollers 12 that are rotating discharge the paper sheet P onto a discharged-sheet unit 13 in the direction indicated by an arrow C shown in FIG. 1.

Duplex printing for forming another image on the other surface is performed in the following manner. A switch claw 15 changes its position to the one indicated by a dotted line shown in FIG. 1, when the paper sheet P is conveyed by the sheet discharging rollers 12 to a point where the back edge of the sheet S reaches a switching point 14. Once the switch claw 15 changes its position, each of the sheet discharging rollers 12 starts rotating in the direction opposite to the original direction. Accordingly, the paper sheet P is conveyed back to the resist rollers 9 through a duplex-printing path 16 and a re-feeding path 17 in the direction indicated by an arrow D. Depending on the rotation of the resist rollers 9, the paper sheet P is conveyed to be positioned between the intermediate transfer belt 21 and the secondary transfer roller 10. Thereafter, a layered toner image, obtained by primarily transferring toner images onto the transfer belt 21, on the transfer belt 21 is secondary-transferred to the other surface of the paper sheet P. The toner image on the other surface is fixed while the paper sheet P passes through the fixing unit 2 as the toner image on the one surface is fixed. Thereafter, the sheet discharging rollers 12 discharge the paper sheet P onto the discharged-sheet unit 13.

Figure 2:
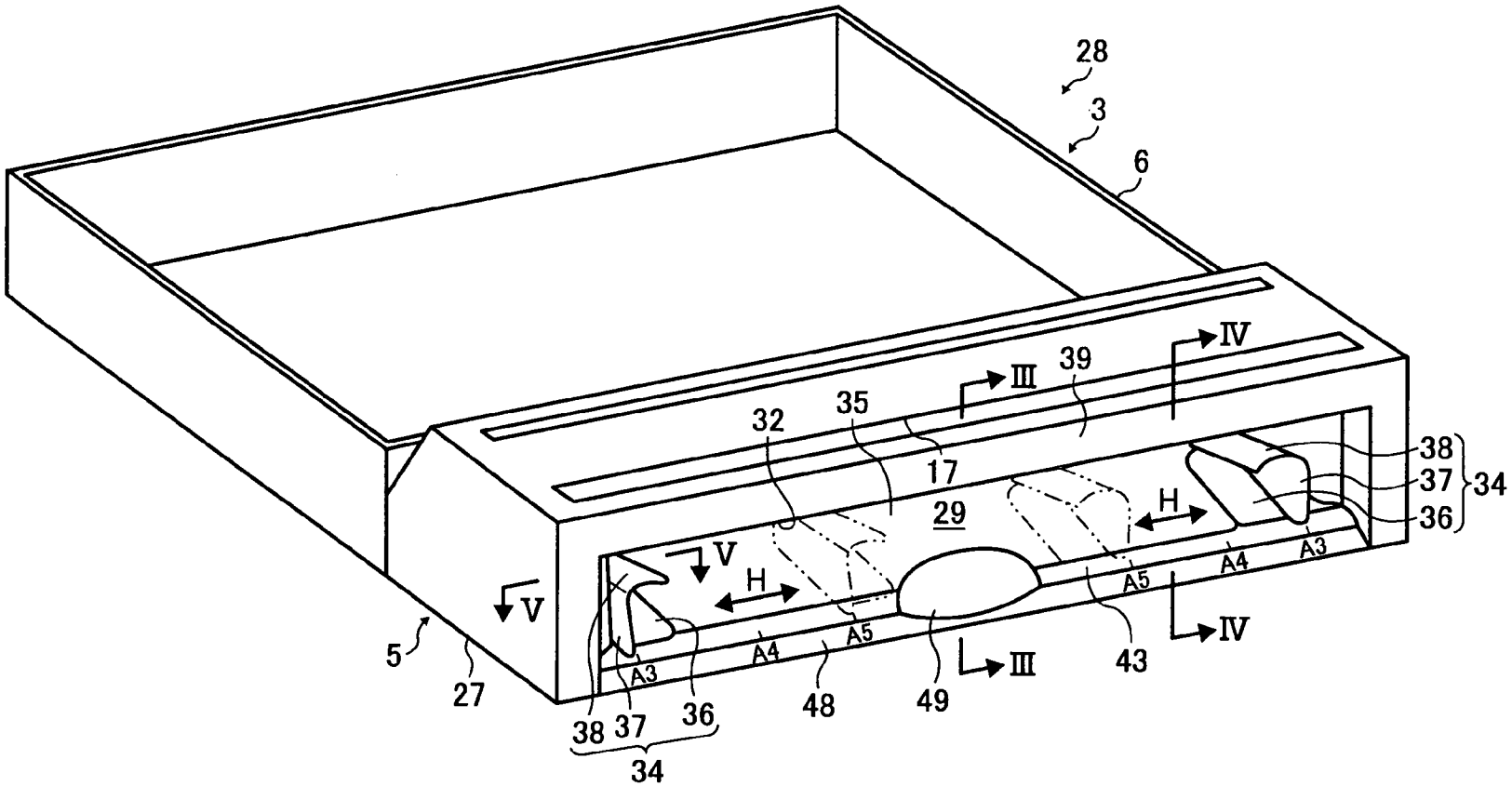
FIG. 2 is a detailed perspective view of a sheet feeding unit.
Figure 3:
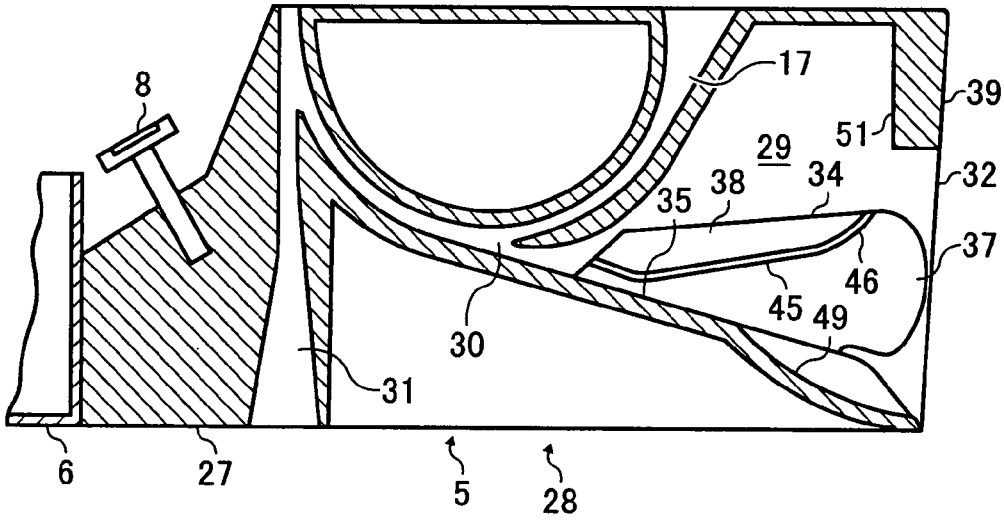
FIG. 3 is an enlarged cross section of the sheet-feeding unit taken along the line III-III shown in FIG. 2.

The manual sheet-feeding device 5 is used to manually feed a single paper sheet from the outside of the image-forming-apparatus body 4. As shown in FIGS. 1 to 3, an apparatus body 27 of the manual paper-feeding device 5 is integrated with the sheet tray 6 of the sheet feeding device 3, and the manual paper-feeding device 5 and the sheet tray 6 constitute a sheet feeding unit 28. The sheet feeding unit 28 is configured to be pulled forward to be at the front of the image-forming-apparatus body 4 in the direction indicated by an arrow E to replenish the paper sheets P on the sheet tray 6, and is configured to be inserted into the image-forming-apparatus body 4 in the direction indicated by an arrow F.

Figure 4:
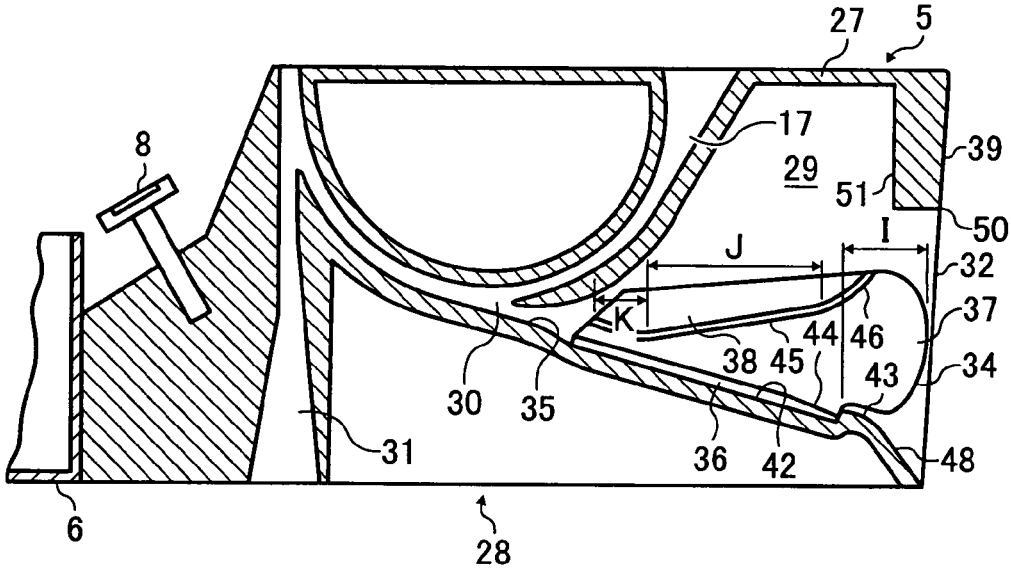
FIG. 4 is an enlarged cross section of the sheet-feeding unit taken along the line IV-IV shown in FIG. 2.
Figure 5:
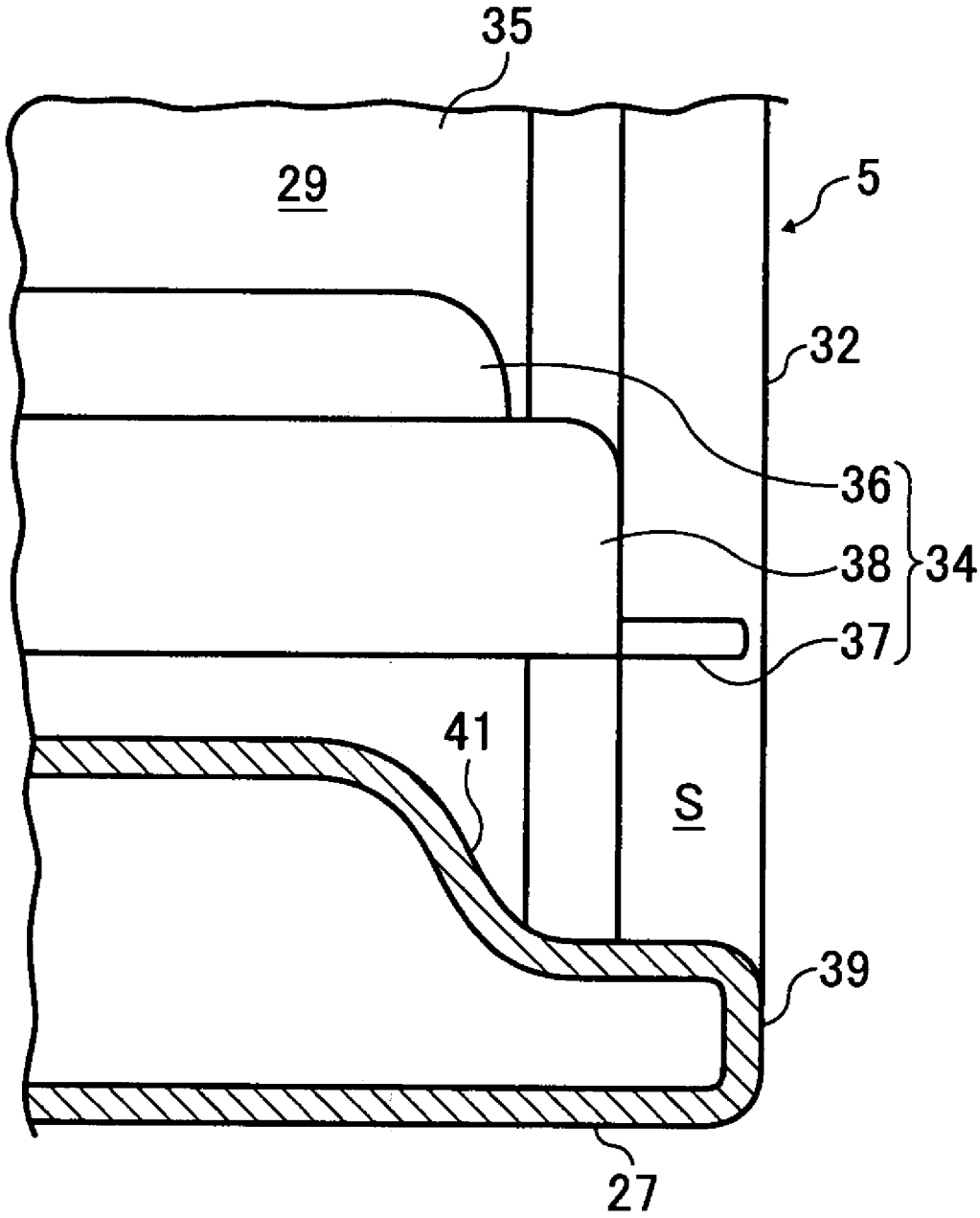
FIG. 5 is an enlarged cross section of a part of a manual sheet-feeding device taken along the line V-V shown in FIG. 2.

FIG. 2 depicts the sheet feeding unit 28 taken out of the image-forming-apparatus body 4. FIG. 3 is an enlarged cross section of the sheet-feeding device taken along the line III-III shown in FIG. 2, FIG. 4 is an enlarged cross section of the sheet-feeding device taken along the line IV-IV shown in FIG. 2, and FIG. 5 is an enlarged cross section of a part of a manual sheet-feeding device taken along the line V-V shown in FIG. 2. As shown in FIGS. 1 to 5, a sheet feeding opening 29 is formed in the apparatus body 27. Furthermore, as shown in FIGS. 1 to 4, the re-feeding path 17 is present in the apparatus body 27 and connects with the sheet feeding opening 29 at a connection point 30. When a different sheet feeding device is arranged below the sheet-feeding unit 28, a sheet feeding path 31 through which a sheet fed by the sheet feeding device passes is formed in the apparatus body 27. The re-feeding path 17 also connects with the sheet feeding path 31.

As shown in FIG. 1, a paper sheet $P_1$ is manually inserted from an opening 32 into the sheet feeding opening 29 by a user in the direction indicated by an arrow G. The paper sheet $P_1$ is then inserted into the re-feeding path 17 through the connecting point 30 while being supported by a bottom surface 35 of the sheet feeding opening 29, the bottom surface 35 serving as a guiding surface for supporting and guiding the paper sheet $P_1$. After being detected by a resist sensor 33 positioned in front of the resist rollers 9, the top edge of the paper sheet $P_1$ bumps against the resist rollers 9 and thus the sheet $S_1$ is adjusted.

After the top edge of the paper sheet $P_1$ is detected and a certain period passes, the resist rollers 9 are driven to rotate at a certain angle, and hence, the paper sheet $P_1$ is interposed between the resist rollers 9 and conveyed for a small distance and stops at a stand-by position. Subsequently, the resist rollers 9 resumes the rotation, and accordingly, the paper sheet $P_1$ is conveyed and positioned between the transfer belt 21 and the secondary transfer roller 10 so that the layered toner image on the intermediate transfer belt 21 is secondary-transferred to the paper sheet $P_1$ in the same manner described above. After the paper sheet $P_1$ is conveyed to the fixing unit 2 and the toner image thereon is fixed, the sheet discharging rollers 12 discharge the paper sheet $P_1$ to the discharged-sheet unit 13. Another image can be formed on the other surface of the sheet $S_1$ in the same manner described above.

As shown in FIG. 2, adjusting members 34 of a pair are symmetrically arranged on the left and the right in the sheet feeding opening 29 so as to oppose to each other. The adjusting members 34 can be interlocked by a known interlocking unit (not shown) and are movable in a direction substantially same as that of the width direction of the paper sheet $P_1$ (hereinafter, "sheet-width direction") inserted into the sheet feeding opening 29 so as to close to or separate from each other. The adjusting members 34 indicated by the solid line shown in FIG. 2 are in the positions where the distance between the adjusting members 34 is the maximum (hereinafter, "maximum distance positions"). Meanwhile, the adjusting members 34 indicated by the chain double dashed lines shown in FIG. 2 are in the positions where the distance between the adjusting members 34 is the minimum.

As shown in FIGS. 2 and 4, each of the adjusting members 34 includes a lower guiding portion 36, a sheet adjusting portion 37 and an upper guiding portion 38. The lower guiding portion 36 rests on the bottom surface 35 of the sheet feeding opening 29 so as to be slidable in the sheet-width direction. The sheet adjusting portion 37 is erect on and integral with the lower guiding portion 36. The upper guiding portion 38 is integral with the top of the sheet adjusting portion 37 and positioned above the lower guiding portion 36.

A user pinches any one of the sheet adjusting portions 37 to move the adjusting members 34 in the sheet-width direction. Accordingly, each of the edges of the paper sheet $P_1$ parallel to a direction in which the paper sheet $P_1$ is inserted into the sheet feeding opening 29 (hereinafter, "sheet insertion direction") abuts on each of the sheet adjusting portions 37 and rests on each of the lower guiding portions 36. In this manner, the top edge of the paper sheet $P_1$ is interposed between the resist rollers 9 and the paper sheet $P_1$ stops at a standby position. The resist rollers 9 are then caused to rotate to guide the paper sheet $P_1$ to the image forming device 1 in a way that the edges of the paper sheet $P_1$ parallel to the sheet insertion direction are supported by the lower guiding portions 36 and adjusted by the sheet adjusting portions 37. In this manner, the paper sheet $P_1$ can be fed properly.

Although it ha s been explained above that the manual sheet-feeding device 5 includes a pair of the adjusting members 34, the manual sheet-feeding device 5 can include a single adjusting member 34 configured to adjust the position of one of the edges of the paper sheet $P_1$ parallel to the sheet insertion direction. As described, the manual sheet-feeding device 5 includes the apparatus body 27, and at least the single adjusting member 34.

As shown in FIGS. 1 to 5, because the adjusting members 34 are positioned in the sheet feeding opening 29, each of the adjusting members 34 does not jut out of the exterior surface 39 of the apparatus body 27 near the opening 32 when being in any position. Hence, the user's cloths can be prevented from getting caught in the adjusting member 34 and the user can be prevented from hitting his hand on the adjusting member 34. Accordingly, the damage of the adjusting members 34 can be prevented. Readjustment of the paper sheet $P_1$ is not necessary as well because there is no risk that the user may hit his hand on the adjusting member 34 and the positions of the adjusting members 34 may thus change.

To move the adjusting members 34, a user usually pinches one of the sheet adjusting portions 37 with the thumb and forefinger. For the fingers, a space S is formed even when the maximum-sized sheet is inserted into the sheet feeding opening 29, in other words, when the adjusting members 34 are in the maximum distance positions. The space S is on each of the two sides in the sheet-width direction that are more close to the outside compared to the adjusting members 34. Accordingly, the user can pinch the adjusting member 34 firmly to move the adjusting members 34 to the maximum-distance positions. If no space is formed, the operability of the adjusting members 34 deteriorates because the user cannot pinch firmly the sheet adjusting portion 37 when the adjusting members 34 are near the maximum-distance positions.

As shown in FIG. 5, a wall surface 41 of the apparatus body 27 forms the space S and serves as a finger guiding surface for guiding the user's finger to the adjusting member 34. Because of the wall surface 41, the finger inserted in the space S naturally moves toward the sheet adjusting portion 37. In this manner, the user can pinch the sheet adjusting portion 37 easily.

Because the bottom surface 35 and the finger guiding surface are integrally formed by the wall surface 41, the structure of the manual sheet-feeding device 5 can be simplified and the costs can be reduced.

As shown in FIG. 4, the sheet adjusting portion 37 is longer than the lower guiding portion 36 by a length I and protrudes toward the opening 32. Hence, the user can easily pinch the sheet adjusting portion 37 to move the adjusting members 34 to desirable positions.

As shown in FIG. 4, a recess portion 42 is formed on the bottom surface 35 of the sheet feeding opening 29, and the lower guiding portions 36 are fitted with the recess portion 42 so as to be slidable in the sheet-width direction. Compared with the recess portion 42, a bottom-surface portion 43 is positioned on the upstream side in the sheet insertion direction. The bottom-surface portion 43 and the upper surface 44 of the lower guiding portion 36 are continuous and have the surfaces at substantially the same level. Alternatively, the surface of the bottom-surface portion 43 is at a level higher than that of the upper surface 44 at their junction on the lower guiding portion 36. Accordingly, the paper sheet $P_1$ can be inserted into the sheet feeding opening 29 smoothly because the top edge of the paper sheet $P_1$ can be prevented from bumping against the lower guiding portions 36 and sliding into a side below the lower guiding portions 36.

The paper sheet $P_1$ is inserted into the sheet feeding opening 29 such that each of the edges of the paper sheet $P_1$ along the sheet insertion direction is positioned between a corresponding one of the lower guiding portions 36 and a corresponding one of the upper guiding portions 38. Hence, even when the edges lift, the upper guiding portions 38 inhibit the edges from lifting more so that the paper sheet $P_1$ can be fed properly. Furthermore, a part of an edge 45 of each of the upper guiding portions 38 that corresponds to portions J and K shown in FIG. 4 extends straight in the direction parallel to the sheet insertion direction. In other words, each of the upper guiding portions 38 extends in a large area above a corresponding one of the edges, and accordingly, the paper sheet $P_1$ can be prevented from lifting and guided securely.

A portion 46 of the edge 45 on the upstream side slopes up, and the extension of the portion 46 reaches a point at a height substantially equal to that of an upper end portion 50 of the opening 32 or a point lower than the upper end portion 50. Because each of the lower guiding portions 36 slopes up in the sheet insertion direction, the paper sheet $P_1$ can be easily inserted into the sheet-feeding opening 29 even if the sheet feeding opening 29 is positioned in a lower portion of the image forming apparatus. Even when the paper sheet $P_1$ is inserted from above into the sheet feeding opening 29, the paper sheet $P_1$ can be assuredly guided to the apparatus body 27 because of the lower guiding portions 36. As shown in FIG. 4, a space is formed between the upper end portion 50 and an upper edge of each of the sheet adjusting portions 37 on an upstream side in the sheet insertion direction. Depending on the space, the user can easily reach his hand to the adjusting member 34 to pinch the sheet adjusting portion 37. In this manner, the user can move easily the adjusting member 34 in the sheet-width direction to position the adjusting members 34. The space also allows the user to see the adjusting members 34 each including the upper edge on the upstream side of the sheet adjusting portion 37 in the sheet insertion direction, improving the operability of the adjusting members 34.

As shown in FIG. 4, an apparatus body surface 48 that is flat is more close to the bottom-surface portion 43 than to the adjusting member 34. On the apparatus body surface 48, indices of standard sheet sizes, such as characters A5, A4 and A3, are formed as shown in FIG. 2. Furthermore, as shown in FIG. 2, a rounded portion that obliquely looks up is formed in the bottom-surface portion 43, and graduation marks corresponding to the standard sheet sizes are formed on the rounded portion.

Because the user slides the adjusting members 34 to position the adjusting members 34, using the graduations, the user can feed each sheet of each size assuredly. The user can look down easily the graduations and the indices of the standard sheet sizes because of the rounded portion and the apparatus body surface 48 that slopes up in the sheet insertion direction.

In some cases, the top edge of a short paper sheet inserted into the sheet feeding opening 29 is interposed between the resist rollers 9 and the short paper sheet is in the standby position, and thus, only a small rear portion is in the sheet feeding opening 29. In such a case, the apparatus body 27 interrupts the user's fingers that hold the short paper sheet so that the short paper sheet cannot be fed straight, and there is the risk that an error such as skew or a registration error may occur. There is the risk as well that a user cannot pull the short paper sheet easily to adjust the short paper sheet after the short paper sheet reaches the stand-by position, because only the small portion of the short paper sheet is in the sheet feeding opening 29.

To avoid such risks, a recess 49 is formed at the center of the bottom surface 35 according to the embodiment as shown in FIGS. 2 and 3. Accordingly, the user can hold assuredly even a small rear portion of a paper sheet in the sheet feeding opening 29 while inserting the fingers into the recess 49, thus pulling the paper sheet from the standby position. In the manner, the recess 49 allows the user to handle easily the paper sheet inserted into the sheet feeding opening 29.

In the manual sheet-feeding device 5 according to the embodiment, the apparatus body 27 is detachably attached to the image-forming-apparatus body 4 such that the exterior surface 39 of the apparatus body 27 is substantially on the same plane as that of exterior surface of the image-forming-apparatus body 4. A portion of the apparatus body 27 serves as a handle 51 for detaching and attaching the apparatus body 27 from and to the image-forming-apparatus body 4. Accordingly, an independent handle is unnecessary and the cost of the manual sheet-feeding device can be reduced.

The sheet feeding opening 29 can be formed in the image-forming-apparatus body 4 but in the apparatus body 27. In such a case, an apparatus body of a manual sheet-feeding device is formed of an image-forming-apparatus body.

Although the image forming apparatus that includes the manual sheet-feeding device 5 and the image forming device 1 is described above, the manual sheet-feeding device 5 can be applied to various apparatuses other than image forming apparatuses, such as scanners or original-sheet feeding apparatuses.

According to an aspect of the present invention, the user's cloths can be prevented from getting caught in the adjusting member, and the user can be prevented from hitting his hand on the adjusting member.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A manual sheet-feeding device comprising:

an apparatus body having an exterior surface, a sheet feeding opening for inserting a sheet into the apparatus body, and an opening for inserting the sheet into the sheet feeding opening, the sheet feeding opening has a bottom surface that serves as a sheet guiding surface that supports the sheet and guides the sheet into the apparatus body while being positioned below the sheet; and an adjusting member that is positioned in the sheet feeding opening and that does not extend out of the exterior surface, that is movable in a direction substantially orthogonal to a direction of insertion of the sheet into the sheet feeding opening for adjusting a position of the sheet, and that guides the sheet in interior of the apparatus body, the adjusting member includes:

a lower guiding member that slidably rests on the bottom surface, and that is configured to support an edge of the sheet that is parallel to the direction of insertion of the sheet into the sheet feeding opening and guide the sheet into the apparatus body while being positioned below the sheet; and a sheet adjusting portion that erects on the lower guiding member and that is configured to adjust a position of the edge and guide the sheet into the apparatus body, wherein the sheet adjusting portion is closer to the opening than the lower guiding member.

2. The manual sheet-feeding device according to claim 1, wherein the bottom surface has a recess portion and the lower guiding member is slidably fitted to the recess portion, wherein the bottom surface has a portion closer to the opening than the recess portion, and the lower guiding member has an upper surface, and the portion of the bottom surface is at a level not lower than that of the upper surface of the lower guiding member at a junction between the portion of the bottom surface and the upper surface of the lower guiding member.

3. A manual sheet-feeding device comprising:

an apparatus body having an exterior surface, a sheet feeding opening for inserting a sheet into the apparatus body, and an opening for inserting the sheet into the sheet feeding opening;

an adjusting member that is positioned in the sheet feeding opening and that does not extend out of the exterior surface, that is movable in a direction substantially orthogonal to a direction of insertion of the sheet into the sheet feeding opening for adjusting a position of the sheet, and that guides the sheet in interior of the apparatus body, the adjusting member includes:

a lower guiding member that slidably rests on the bottom surface, and that is configured to support an edge of the sheet that is parallel to the direction of insertion of the sheet into the sheet feeding opening and guide the sheet into the apparatus body while being positioned below the sheet; and a sheet adjusting portion that erects on the lower guiding member and that is configured to adjust a position of the edge and guide the sheet into the apparatus body, and a space for inserting a finger is formed in the apparatus body when the adjusting member is located at a position where a maximum-sized sheet can be guided into the apparatus body, the space being positioned on a side that is closer to outside than the adjusting member in the direction orthogonal to the direction of insertion of the sheet into the sheet feeding opening, wherein the sheet adjusting portion is closer to the opening than the lower guiding member.

4. The manual sheet-feeding device according to claim 3, wherein the sheet feeding opening comprises a bottom surface, the bottom surface has a recess portion and the lower guiding member is slidably fitted to the recess portion, wherein the bottom surface has a portion closer to the opening than the recess portion, and the lower guiding member has an upper surface, and the portion of the bottom surface is at a level not lower than that of the upper surface of the lower guiding member at a junction between the portion of the bottom surface and the upper surface of the lower guiding member.

5. An image forming apparatus comprising:

a sheet-feeding device including a sheet feeding unit, the sheet feeding unit integrally includes a sheet tray for storing paper sheet;

a re-feeding path through which the paper sheet passes when duplex printing for forming another image on the other surface of the paper sheet is performed; and a sheet feeding opening into which the paper sheet is inserted from the outside of a device, wherein the sheet feeding opening connects with the re-feeding path at a connection point, and the sheet feeding opening has a bottom surface by which the paper sheet is supported, and when the sheet feeding unit is pulled forward to be at a front of an image-forming-apparatus body to replenish the paper sheet on the sheet tray, the bottom surface of the sheet feeding opening does not extend out of an exterior surface of the sheet feeding unit.

6. The image forming apparatus according to claim 5, wherein the bottom surface of the sheet feeding opening serves as a sheet guiding surface that supports the sheet and guides the sheet into the image-forming-apparatus body while being positioned below the sheet.

7. The image forming apparatus according to claim 5, further comprises an adjusting member that is positioned in the sheet feeding opening and that does not extend out of the exterior surface, that is movable in a direction substantially orthogonal to a direction of insertion of the sheet into the sheet feeding opening for adjusting a position of the sheet, and that guides the sheet in interior of the apparatus body.

8. The image forming apparatus according to claim 7, wherein the adjusting member includes:

a lower guiding member that slidably rests on the bottom surface, and that is configured to support an edge of the sheet that is parallel to the direction of insertion of the sheet into the sheet feeding opening and guide the sheet into the apparatus body while being positioned below the sheet; and a sheet adjusting portion that erects on the lower guiding member and that is configured to adjust a position of the edge and guide the sheet into the apparatus body.

9. The image forming apparatus according to claim 8, wherein the sheet adjusting portion is closer to the opening than the lower guiding member.

10. The image forming apparatus according to claim 7, wherein a space for inserting a finger is formed in the apparatus body when the adjusting member is located at a position where a maximum-sized sheet can be guided into the apparatus body, the space being positioned on a side that is closer to outside than the adjusting member in the direction orthogonal to the direction of insertion of the sheet into the sheet feeding opening.

11. The image forming apparatus according to claim 10, wherein the apparatus body has a wall surface that defines the space and that has a guiding surface for guiding the finger that is inserted in the space to the adjusting member.

* * * * *